US007197901B2

(12) United States Patent
Monteiro et al.

(10) Patent No.: US 7,197,901 B2
(45) **Date of Patent: *Apr. 3, 2007**

(54) WASHING MACHINE

(75) Inventors: André Fraser Monteiro, Wiltshire (GB); Geoffrey Michael Burlington, Gloucestershire (GB)

(73) Assignee: Dyson Technology Limited, Wiltshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/833,302

(22) Filed: Apr. 28, 2004

(65) Prior Publication Data

US 2005/0005653 A1 Jan. 13, 2005

Related U.S. Application Data

(63) Continuation of application No. 09/956,248, filed on Sep. 20, 2001, now Pat. No. 6,854,300, which is a continuation-in-part of application No. 09/309,865, filed on May 11, 1999, now Pat. No. 6,311,527.

(30) Foreign Application Priority Data

May 12, 1998 (GB) ..... 9810173.6

(51) Int. Cl.
*D06F 37/06* (2006.01)

(52) U.S. Cl. ..... 68/24; 68/140

(58) Field of Classification Search ..... 68/24; 58/58, 242; 366/228, 232, 234
See application file for complete search history.

(56) References Cited

U.S. PATENT DOCUMENTS

| | | | | |
|---|---|---|---|---|
| 402,865 A | | 5/1889 | Smith | |
| 886,745 A | | 5/1908 | Vieman | |
| 1,010,436 A | | 12/1911 | Kenney | |
| 1,444,993 A | | 2/1923 | Wenger | |
| 1,913,151 A | | 6/1933 | Butzbach | |
| 1,925,049 A | | 8/1933 | Howard | |
| 1,931,499 A | * | 10/1933 | Klugh | 425/200 |
| 2,180,225 A | | 11/1939 | Dewhurst | |
| 2,205,130 A | | 6/1940 | Belding | |
| 2,310,950 A | | 2/1943 | Goldman | |
| 2,317,117 A | * | 4/1943 | Schmelzer | 74/606 R |
| 2,330,420 A | | 9/1943 | Haberstump | |
| 2,344,047 A | | 3/1944 | Lowe | |
| 2,360,377 A | | 10/1944 | Vetorino | |

(Continued)

FOREIGN PATENT DOCUMENTS

| | | |
|---|---|---|
| CA | 1049803 | 3/1979 |

(Continued)

OTHER PUBLICATIONS

European Patent Office 0 509 931 Oct. 1992.*

*Primary Examiner*—Frankie L. Stinson
(74) *Attorney, Agent, or Firm*—Morrison & Foerster LLP

(57) ABSTRACT

The invention provides an apparatus comprising a drum for containing and agitating an article, wherein the drum comprises at least two rotatable portions in rotatable connection with one another, a rotator member in connection with each rotatable portion for rotating the portion about an axis. The apparatus is preferably a washing machine, and the method of operating the apparatus comprises inserting at least one article, preferably a plurality of articles, into the drum; and rotating each rotatable portion independently of one another to agitate the article or articles.

37 Claims, 6 Drawing Sheets

U.S. PATENT DOCUMENTS

| | | | | | |
|---|---|---|---|---|---|
| 2,374,247 | A | | 4/1945 | Thaxton | |
| 2,376,106 | A | | 5/1945 | Witthofft. | |
| 2,439,215 | A | * | 4/1948 | Lund | 68/23 R |
| 2,463,683 | A | * | 3/1949 | Fay | 38/143 |
| 2,500,368 | A | * | 3/1950 | Lund | 68/23 R |
| 2,540,168 | A | | 2/1951 | Kahn | |
| 2,556,153 | A | * | 6/1951 | Collins | 68/20 |
| 2,575,691 | A | | 11/1951 | Smith | |
| 2,784,500 | A | * | 3/1957 | Beaumont | 34/58 |
| 2,787,150 | A | | 4/1957 | Sulzmann | |
| 3,006,334 | A | * | 10/1961 | Newell | 126/110 AA |
| 3,035,430 | A | | 5/1962 | Rothenberger | |
| 3,229,964 | A | | 1/1966 | Wiseman | |
| 3,245,154 | A | | 4/1966 | Bojner et al. | |
| 3,293,891 | A | | 12/1966 | Sulzmann | |
| 3,416,334 | A | * | 12/1968 | Candor et al. | 68/20 |
| 3,594,918 | A | * | 7/1971 | Quester et al. | 34/131 |
| 3,869,883 | A | | 3/1975 | Rotter | |
| 3,995,458 | A | | 12/1976 | Grunewald et al. | |
| 4,020,659 | A | * | 5/1977 | Bhavsar | 68/27 |
| 4,046,496 | A | | 9/1977 | Gorin et al. | |
| 4,136,537 | A | | 1/1979 | Harrsch | |
| RE30,214 | E | | 2/1980 | Bhavsar | |
| 4,236,393 | A | * | 12/1980 | Katzfey | 68/27 |
| 4,440,637 | A | * | 4/1984 | Smit et al. | 209/241 |
| 4,453,556 | A | * | 6/1984 | Corbett | 134/65 |
| 4,584,732 | A | * | 4/1986 | Kohsaka | 8/159 |
| 5,025,645 | A | | 6/1991 | Eck et al. | |
| 5,211,039 | A | * | 5/1993 | Pellerin | 68/27 |
| 5,267,456 | A | | 12/1993 | Nukaga et al. | |
| 5,421,103 | A | * | 6/1995 | Wunderlich | 34/599 |
| 5,546,292 | A | * | 8/1996 | Shemitz | 362/234 |
| 6,311,527 | B1 | | 11/2001 | Monteiro et al. | |

FOREIGN PATENT DOCUMENTS

| | | | |
|---|---|---|---|
| CA | 1095734 | | 2/1981 |
| EP | 0509931 | | 10/1992 |
| EP | 0688894 | | 12/1995 |
| GB | 2141742 | | 1/1985 |
| GB | 2142937 | * | 1/1985 |
| GB | 2145435 | | 3/1985 |
| JP | 60-63089 | * | 4/1985 |
| JP | 60-182999 | * | 9/1985 |
| JP | 03111089 | | 10/1991 |
| SU | 619345 | | 8/1978 |
| TW | 162301 | | 7/1991 |
| WO | WO-92/09361 | | 6/1992 |

* cited by examiner

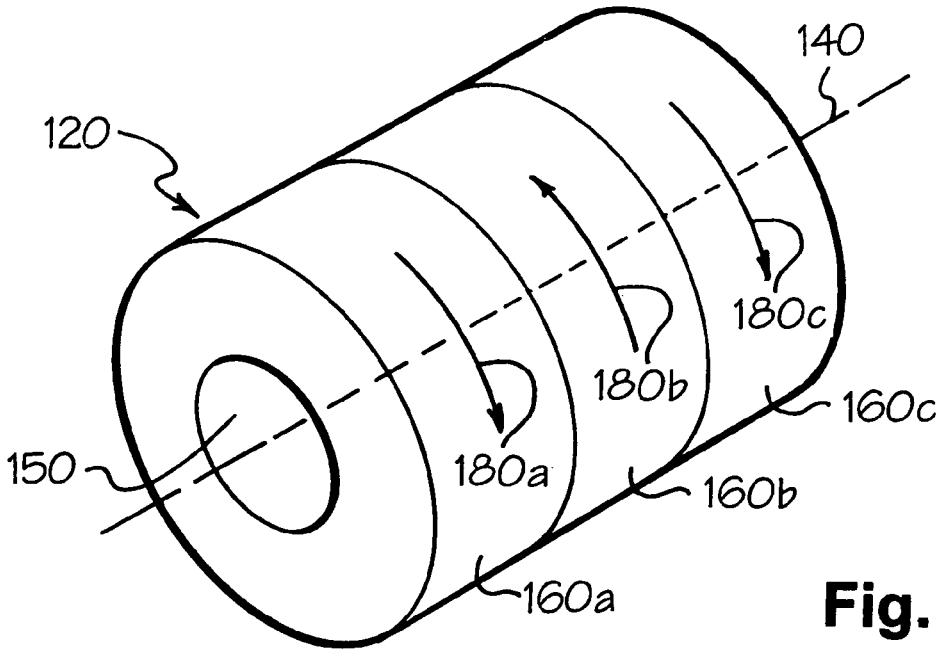
Fig. 4.
Fig. 5.
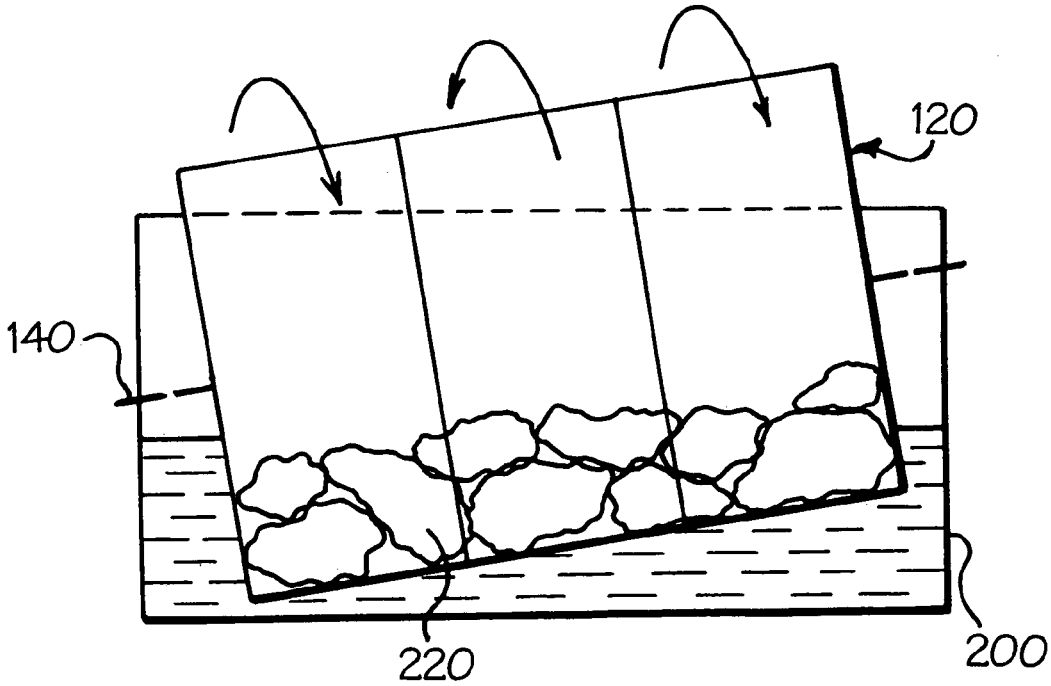

Fig. 9.
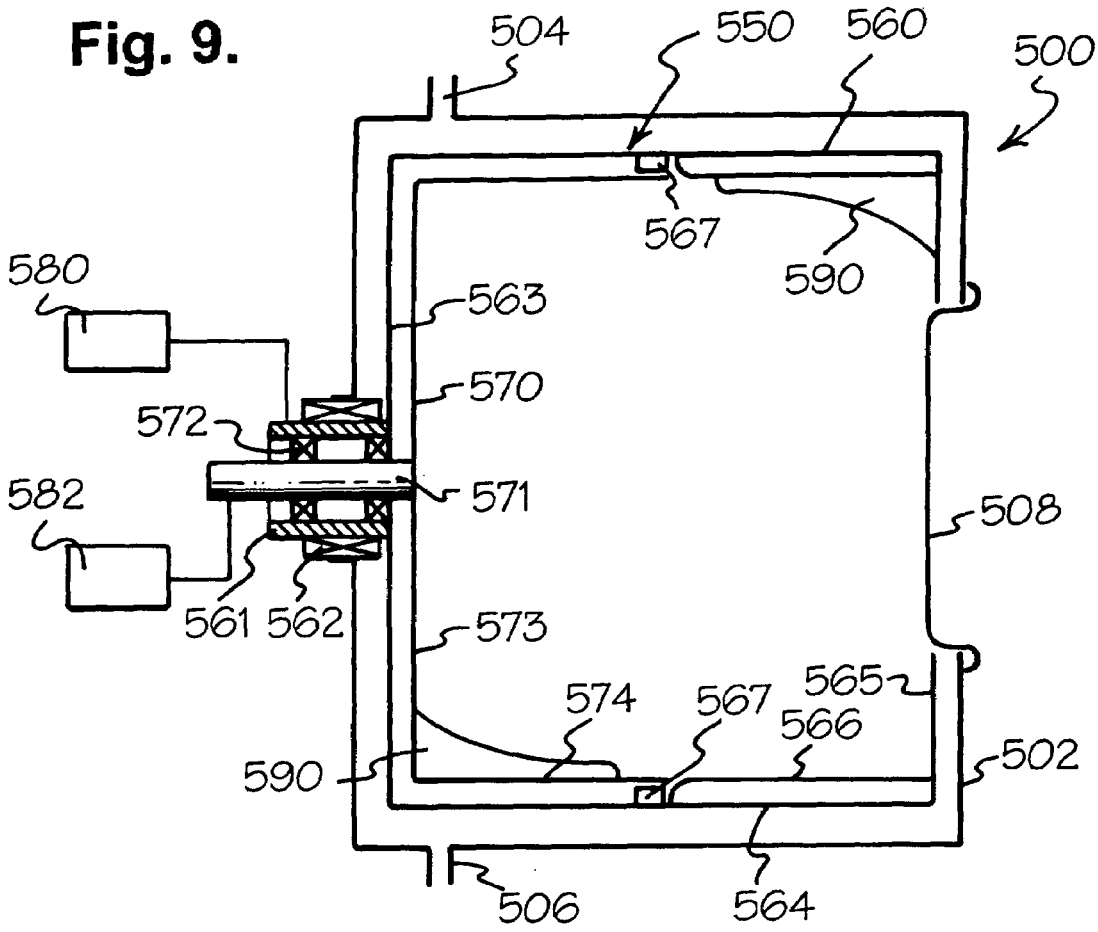
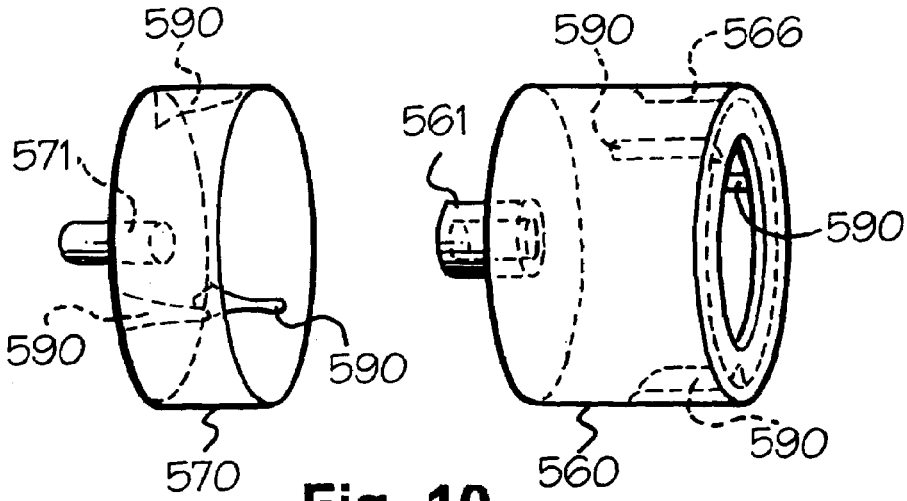
Fig. 10.

WASHING MACHINE

REFERENCE TO RELATED APPLICATIONS

This application is a continuation of Ser. No. 09/956,248, filed Sep. 20, 2001, now U.S. Pat. No. 6,854,300 which is a continuation-in-part of Ser. No. 09/309,865, filed May 11, 1999, now U.S. Pat. No. 6,311,527.

FIELD OF THE INVENTION

The invention relates to a method and apparatus for containing and agitating at least one article. The invention has application in any situation where articles are required to be treated by agitation for purposes as varied as cleaning, polishing, grinding, granulating, peeling and coating. Preferably, the invention is used in the laundry field in order to carry out cleaning (washing) or fabric treatment processes. Particularly, but not exclusively, the invention relates to an improved washing machine.

BACKGROUND OF THE INVENTION

Devices which agitate articles within a rotating drum in the presence of a fluid are known. For example, U.S. Pat. No. 5,350,323, discloses a dual drum mixer which can be used to mix, homogenize or react at least two components. The device is a container made of two separately driveable pipe lengths adjacent to one another. The container is sealed, with fluid being injected into the container through its longitudinal axes. The device is limited in use in that fluid entry is only through its axes and the fluid must be sealed within the container in order for proper mixing or agitation to occur.

In agitation devices such as conventional washing machines, a perforated drum is used to contain articles as they are agitated in the presence of water and detergent in order to remove dirt. The dirt is displaced into the water, and the water is removed from the drum by passing through the perforations. In front-loading washing machines, agitation is caused by the rotation of the drum about a generally horizontal axis so that the articles tumble over one another and rub against each other and against the walls of the drum. However, the rotational speed of the drum is limited because, if the speed is too high, the articles will merely be pressed under centrifugal forces against the interior walls of the drum. The articles then rotate with the drum and no agitation with respect to the drum or with respect to other articles is achieved. The amount of agitation which can be applied to the articles by front-loading washing machines is therefore limited. This means that, in order to achieve a specific standard of cleanliness, the machine must operate for a minimum period of time.

SUMMARY OF THE INVENTION

In order to overcome many problems inherent in the prior art, the present invention provides an apparatus and method for enhancing the agitation of articles. The apparatus comprises a drum for containing and agitating an article, wherein the drum comprises at least two rotatable portions in rotatable connection with one another, a rotator member in connection with each rotatable portion for rotating the drum portion about an axis. Preferably the drum has at least one port for intake or exhaust of a liquid into or out of an area internal to the drum. More preferably, the at least one port is located on a peripheral portion of at least one of the rotatable portions. The drum can be seated within a tank.

The apparatus can include a drive in connection with each rotator member. The rotatable portions are, preferably, rotatable about a common axis, and the axis can be horizontal or inclined to the vertical. The rotatable portions can be of a variety of shapes and sizes so that the apparatus can function as a polisher, grinder, granulator, peeler, coater or washing machine. The apparatus is preferably a washing machine.

The drive comprises a motor connected to a coupler, and a controller can be connected to the motor to control speed and directional rotation of the rotatable portions. The rotator member can be connected to a periphery of each rotatable portion, or it can be connected to a shaft adjoining each rotatable portion. The rotator member acts as a friction providing element to facilitate rotation of the rotatable portions.

The drive and rotator member couple such that the rotatable portions can rotate independently of one another. The rotatable portions can be rotated at different speeds and different directions in order to enhance agitation.

The invention also encompasses a method of providing enhanced agitation. The method comprises inserting at least one solid article into a drum, wherein the drum comprises a first rotatable portion and a second rotatable portion in rotatable connection with one another; and rotating the first and second drum portions independently of one another to agitate the article. Preferably, a fluid is provided within the drum as the first and second drum portions are rotated. The fluid is preferably added to or exhausted from the drum through at least one port at a peripheral portion of the drum.

The rotatable portions can be rotated at a variety of speeds and directions. For example, the rotatable portions can be rotated in opposite directions; at the same speed in opposite directions; at different speeds in the same direction; at different speeds in opposite directions; at the same speed and in the same direction; or at least one of the rotatable portions can be held stationary while the other rotatable portion is rotated.

In another embodiment, the invention provides an apparatus which comprises a drum for containing and agitating an article, wherein the drum comprises at least two rotatable portions in rotatable connection with one another, and a rotator member in connection with each rotatable portion for rotating the drum portion about an axis. Two of the rotatable portions at opposite ends of the drum have end walls attached thereto. An opening for inserting the article into the drum can be provided at an end wall or at a peripheral portion of one or more rotatable portions. A door can be provided to maintain the article within the drum during operation. Preferably, one of the rotatable portions is located inside another rotatable portion, and the rotatable portions can be mounted on concentric shafts.

BRIEF DESCRIPTION OF THE DRAWINGS

The present invention will be better understood by reference to the Detailed Description of the Invention when taken together with the attached drawings, wherein:

FIG. 4 is a schematic perspective view of apparatus according to a second embodiment of the invention;

FIG. 5 is a longitudinal cross-sectional view of the apparatus of FIG. 4 in use and forming part of a washing machine;

FIG. 9 is a longitudinal cross-section through an eighth embodiment of the invention;

FIG. 10 is an exploded view of the rotating portions of the drum forming part of the embodiment shown in FIG. 9; and

DETAILED DESCRIPTION OF THE INVENTION

Figure 1:
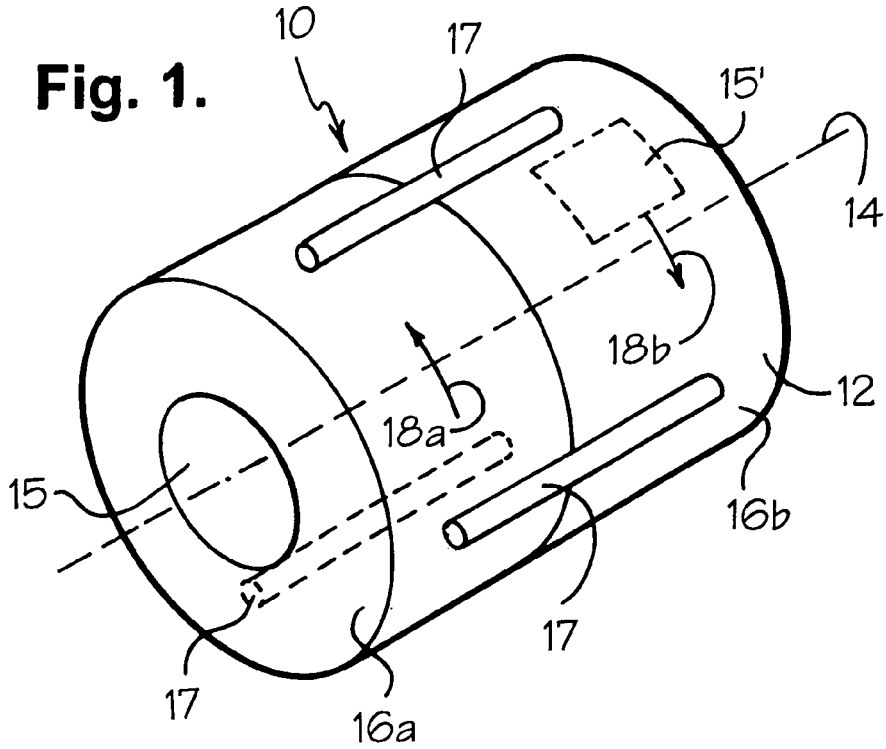
FIG. 1 is a schematic perspective view of apparatus according to a first embodiment of the invention.

The present invention is directed to an apparatus comprising a drum for containing and agitating an article, and a method of agitating an article. The drum of the apparatus comprises at least two rotatable portions in rotatable connection with one another, a rotator member in connection with each rotatable portion for rotating the drum portion about an axis, with at least one of the rotatable portions being perforated. In the method of agitating an article, the drum is operated in such a manner that relative rotation is produced between adjacent rotatable portions of the drum.

In a preferred embodiment, the drum has a drive that is capable of rotating the rotatable portions at different speeds and/or in different directions. More preferably, the drive is capable of rotating adjacent rotatable portions at different speeds in the same direction, at different speeds in opposite directions and/or at the same speed in opposite directions. The relative rotation between the adjacent rotatable portions prevents the articles from becoming adhered to the interior wall of the drum. Therefore, the rotational speed of the rotatable portions can be increased above that at which the articles would normally cease to be agitated, and the amount of agitation applied to the articles can be made more intense. The articles are therefore treated more intensively that they would be in conventional apparatus.

When the drum is used in a washing machine, dirt is released from the articles at a higher rate than in known machines, and the cleaning process is either more thorough in a given time or else the desired standard of cleanliness is achieved more quickly. Preferably, the drum comprises at least one motor, a controller to control the speed and direction of rotation of the drum portions, and a coupler that connects the motor to the drum portions. The type of motor, controller or coupler used is not critical and will be apparent to one of ordinary skill in the art.

Preferably, the drum includes at least two essentially cylindrical rotatable portions. Advantageously, the rotatable portions are capable of being driven at the same speed in opposite directions. This maximizes the agitation of the contents of the drum and, in the context of a washing machine, allows articles to be cleaned to a specific standard very quickly or, if desired, to a very high standard in a specific time. In alternative embodiments, the rotatable portions can be driven at different speeds in the same direction or at different speeds in opposite directions. It is also envisaged that it will be possible to achieve the same effect by retaining one rotatable portion stationary and rotating the other portion in either direction.

The invention also provides a method of containing and agitating a plurality of articles within a defined space, comprising the steps of introducing the articles to the interior of a drum which delimits the defined space and which is rotatable by drive means, and rotating the drum so as to cause agitation between the articles, characterized in that, during at least part of the step of rotating the drum so as to cause agitation between the articles, the drive is operated in such a manner that relative rotation is produced between adjacent rotatable portions of the drum. The method according to the invention will have advantages similar to those of the apparatus according to the invention.

One embodiment of the invention is illustrated in FIG. 1. Essentially, the apparatus 10 comprises a cylindrical drum 12 mounted rotatably about an axis 14. The drum 12 is made up of two separately rotatable portions 16*a*, 16*b*, each consisting of a cylindrical wall and a circular end wall. Each circular end wall closes the respective rotatable portion 16*a*, 16*b* at one side, the open side facing the other respective rotatable portion 16*b*, 16*a*. One of the circular end walls has an opening therein for inserting an article or articles into the drum. A door 15 can be incorporated within the opening to maintain the article or articles within the drum during operation. The door 15 is mounted in a conventional manner and will not be described any further here. It will be understood that this is only one way of providing access to the interior of the drum 12 and, as an alternative, one of the rotatable portions 16*a*, 16*b* can have an opening at a peripheral area, and a door 15' could alternatively be mounted within the opening to maintain the article or articles within the drum. The rotatable portions 16*a*, 16*b* are individually mounted so as to be rotatable about the axis 14, for example by support bearings 17, and are each driven by a separate drive 24*a*, 24*b* (see FIGS. 2 and 3). The drives 24*a*, 24*b* are arranged and adapted so that each rotatable portion 16*a*, 16*b* can be rotated about the axis 14 at a speed or in a direction which is different from that of the other rotatable portion 16*b*, 16*a*. In the illustrated embodiment, the rotatable portion 16*a* can be rotated in the direction of arrow 18*a* at the same time that the rotatable portion 16*b* can be rotated at the same speed in the direction of arrow 18*b*.

Figure 2:
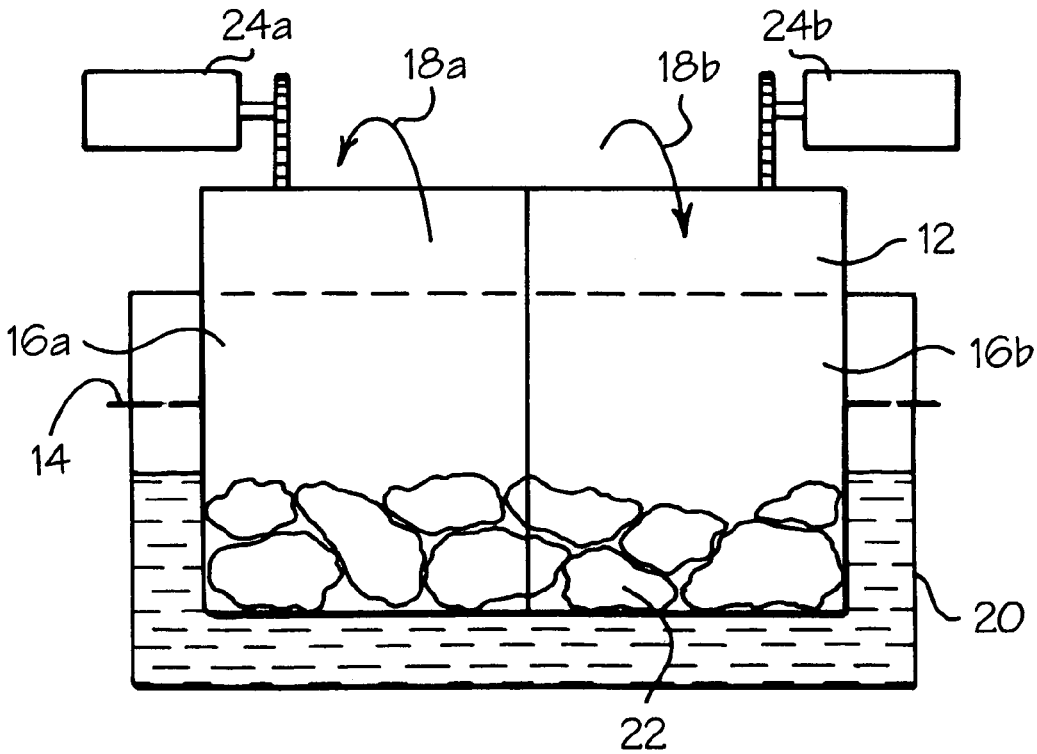
FIG. 2 is a longitudinal cross-sectional view of the apparatus of FIG. 1 in use and forming part of a washing machine.

In FIG. 2, the drum 12 is seated in a tub or tank 20, and contains articles 21 and a liquid 23. The tub or tank 20 can be a polisher, grinder or cleaning machine, preferably a washing machine. The liquid can be a cleaning fluid, preferably a solution of water and detergent or any other type of cleaning composition.

The drum 12 has at least one port, such as a perforation or simple opening, through at least one of the rotatable portions 16*a*, 16*b* in order to allow water to flow into the drum 12 from the tub or tank 20 and vice versa. Preferably, each drum portion 16*a*, 16*b* will have a plurality of ports. Preferably the port or ports will be located on a periphery of the drum. The port or ports can be located in an area between adjoining drum portions 16*a*, 16*b* although, it is preferred that there be at least one port on a peripheral portion of at least one of the rotatable portions 16*a*, 16*b*. There is no need for the rotatable portions 16*a*, 16*b* to be sealed against one another since the flow of water into and out from the drum 12 is acceptable. Two separate drives 24*a*, 24*b* are positioned above the rotatable portions 16*a*, 16*b* in order to drive, independently of one another, the said rotatable portions 16*a*, 16*b*.

When the drives 24*a*, 24*b* are activated, rotatable portion 16*a* is driven by drive 24*a* in the direction of arrow 18*a* and rotatable portion 16*b* is driven by drive 24*b* in the direction of arrow 18*b*. The rotatable portions 16*a*, 16*b* thus rotate about the axis 14 at the same speed but in opposite directions. The articles 22 contained within the drum 12 are agitated as the rotatable portions 16*a*, 16*b* rotate. The articles 22 are continually prevented from sticking to the cylindrical wall of either of the rotatable portions 16*a*, 16*b* by virtue of the fact that a portion of the articles are being rotated in the opposite direction by the other rotatable portion 16*b*, 16*a*. The articles collide and pull one another from the wall of the rotatable portion 16*a*, 16*b* in which they are located. The speed of rotation of each rotatable portion of the apparatus can therefore be higher than can be achieved in known agitation devices. Achieving a higher degree of agitation in a much shorter period of time is also made possible. When the tub or tank 20 is used as a washing machine, a much higher standard of cleanliness in a given period of time can be attained than has previously been possible.

Figure 3A:
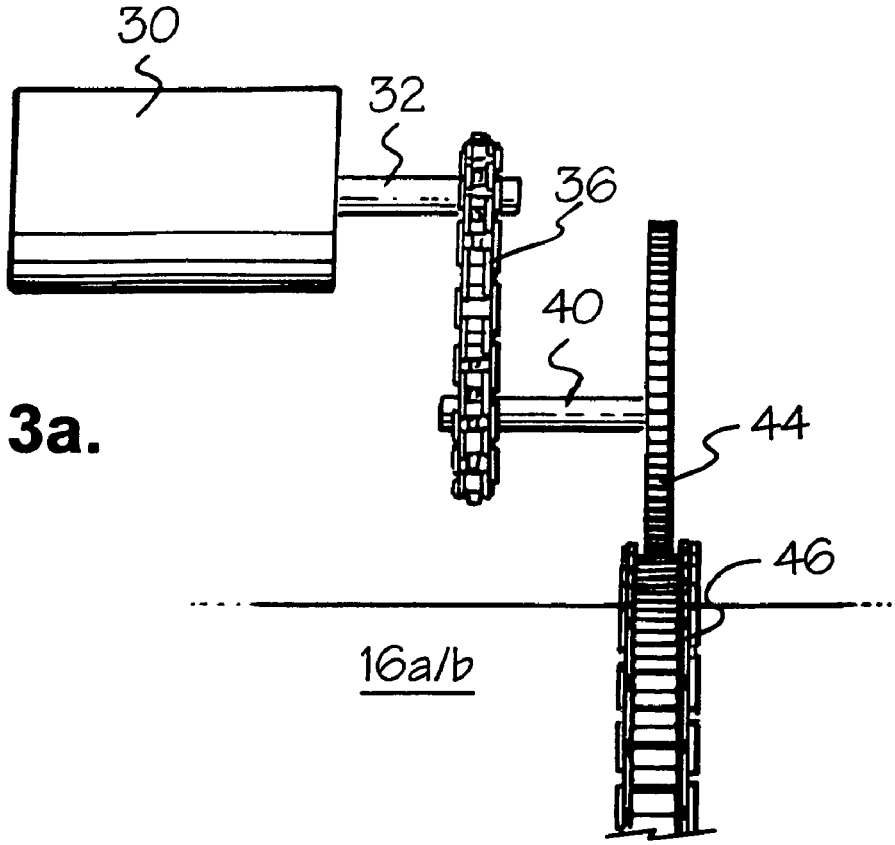
FIG. 3*a* is a front view of the driving mechanism forming part of the apparatus of FIG. 2.
Figure 3B:
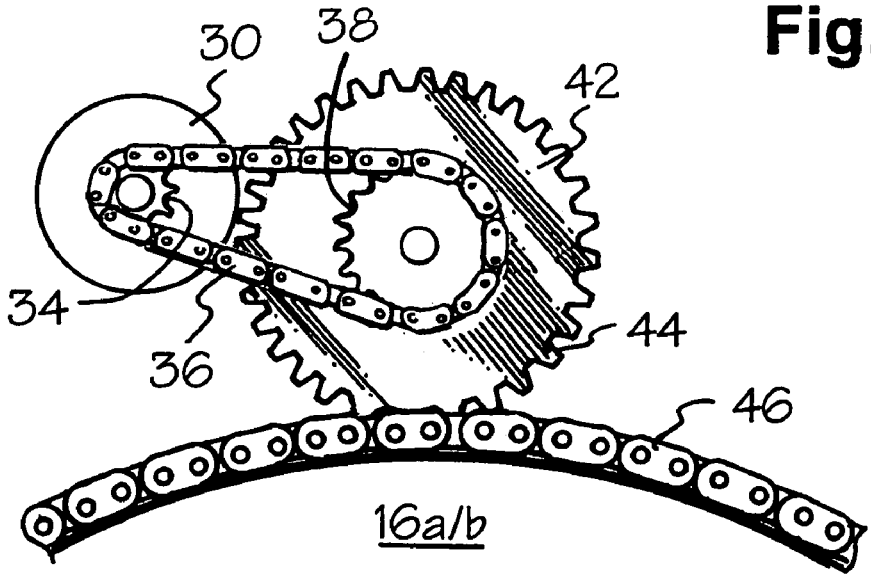
FIG. 3*b* is a side view of the driving mechanism of FIG. 3*a;*

One of the drives 24*a*, 24*b* is illustrated in FIGS. 3*a* and 3*b*. It will be appreciated that the drives 24*a*, 24*b* illustrated in FIG. 2 can be identical to one another. For this reason, only one drive is illustrated here. The illustrated drive to be described below is not to be understood as being the only drive suitable for this purpose. Other drives equally suitable for this application will be immediately apparent to one of ordinary skill in the art. Preferably, the drive comprises a motor and coupler in connection with the motor. A controller for controlling the speed and direction of the drive can also be included.

In the embodiment shown in FIGS. 3*a* and 3*b*, the drive comprises a motor 30 connected to a single coupler unit, the coupler unit being in contact with a rotator member mechanism on the rotatable portion. The coupler unit includes a shaft 32 carrying a first toothed wheel 34. A chain 36 or other linked member engages the first toothed wheel 34 and also a second toothed wheel 38 fixed to a second shaft 40. If desired the shaft 32 or second shaft 40 can be mounted to a support structure on the apparatus housing the drum. The second shaft 40 also carries a third toothed wheel 42, the teeth 44 of which are designed to engage with a rotator member 46. The rotator member is separate from the coupler unit and is connected to the rotatable portion in a fashion such that it can act to rotate the rotatable portion, and can be made of any type of friction providing member. Preferably, the rotator member is a toothed attachment or a chain. In FIG. 3*a* and FIG. 3*b* the rotator member 46 is arranged around the periphery of one of the rotatable portions 16*a*, 16*b*. When the motor 30 is operated, the shaft 32 rotates causing the first toothed wheel 34 to rotate. This drives the chain 36 which causes the second toothed wheel 38 to rotate and, in turn, the third toothed wheel 42. Rotation of the third toothed wheel 42 forces the rotatable portion to which the drive is attached to rotate about the axis 14. The direction of rotation and speed of rotation of the rotatable portion can be determined by the direction of rotation of the motor and by the particular gearing used in the coupler unit. A controller can be used to control the speed and direction of the motor; and the number of gears, gear radius and tooth arrangement of each gear can determine speed and direction of the rotatable portions independently of the controller and motor. This type of speed and directional control will be readily apparent to one of ordinary skill in the art.

It will be appreciated that the toothed wheels 34, 38, 42 and chain or rotator member 36, 46 can be replaced where appropriate by pulleys and drive belts or other equivalent components. If a drive belt is used to drive the rotatable portion 16*a*, 16*b* itself, the drive belt may best be wrapped around a pulley located on or concentric with the axis 14 shown in FIG. 1. The motor can also be connected to a second coupler unit to drive a second drum portion. For example, shaft 32 can extend through the toothed wheel 34 and connect to an additional toothed wheel rotation assembly. The assembly can contact a rotator member on a second drum portion, and the two drum portions can be driven by one motor. The type of gearing used is not critical to the operation of the invention, and can be any type of gearing arrangement that would be known to one of ordinary skill in the art.

Another embodiment is illustrated in FIG. 4. In this embodiment, the drum 120 is made up of three separate rotatable portions 160*a*, 160*b*, 160*c*. Each of the rotatable portions 160*a*, 160*b*, 160*c* has a cylindrical wall and the outermost portions 160*a*, 160*c* also have circular end walls so that the cylindrical drum 120 is essentially closed. An opening can be provided on one of the circular end walls for inserting an article or articles into the drum. A door 150 can be provided in the opening to maintain the article or articles within the drum during operation. Drives similar to those shown in FIG. 3 can be used in order to rotate each rotatable portion 160*a*, 160*b*, 160*c* about the axis 140. Outermost rotatable portions 160*a* and 160*c* are each rotatable in a first direction (see arrows 180*a*, 180*c*), whereas the central rotatable portion 160*b* is rotatable in the opposite direction (see arrow 180*b*), but at the same speed.

The agitation provided to the contents of the drum 120 is once again significantly higher than would be achievable with a conventional washing machine. The rotation of adjacent rotatable portions 160*a*, 160*b*; 160*b*, 160*c* in opposite directions prevents the articles from becoming stuck to the cylindrical walls of the drum 120 simply because other articles, which are being rotated in the opposite direction, will not allow them to be carried around the drum 120. The other articles effectively drag the first articles off the walls and the agitation action is continued, even at high rotational speeds of the rotatable portions 160*a*, 160*b*, 160*c*.

In the arrangement shown in FIG. 5, the agitation provided to the articles 220 contained within the drum 120 is significantly higher than that which can be achieved using known arrangements. As before, the drum 120 is located within a tank or tub 200 containing a fluid, and at least one of the drum portions is perforated so that the fluid can flow from the drum 120 to the tank or tub 200 and vice versa. In this arrangement, however, the drum 120 is mounted within the tank 200 about an inclined axis 140 instead of about a horizontal axis.

Figure 6:
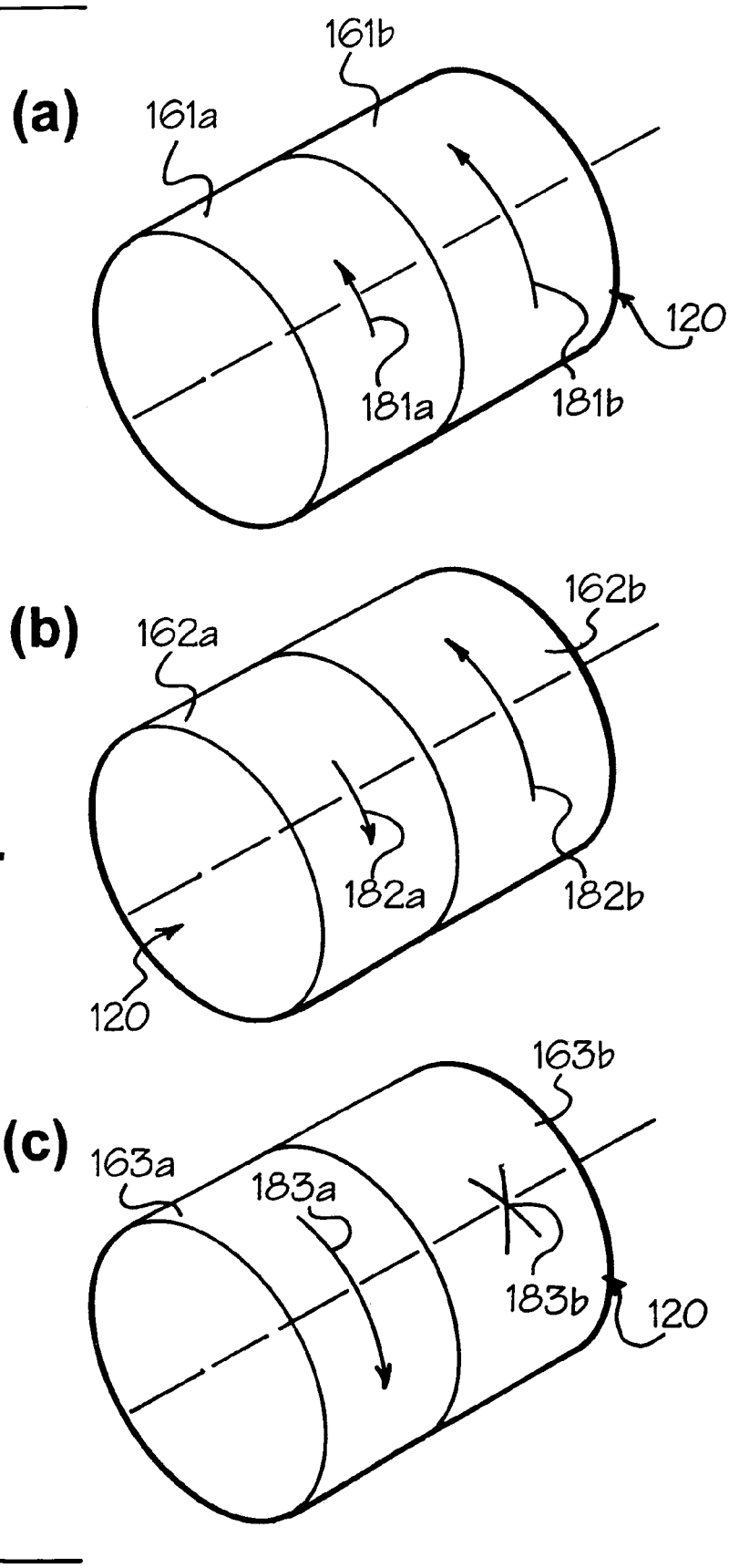
FIGS. 6*a, b* and *c* are schematic perspective views, similar to FIG. 1, of apparatus according to third, fourth and fifth embodiments of the invention.

It will be appreciated that the embodiments described above can be adapted in order to achieve the same or similar effect, particularly with regard to the respective speeds and directions of the rotatable portions. Illustrations of alternative arrangements are given in FIGS. 6*a*, 6*b* and 6*c*. In FIG. 6*a*, the rotatable portions 161*a*, 161*b* are shown rotating in the same direction but at different speeds by arrows 181*a*, 181*b*. In FIG. 6*b*, the rotatable portions 162*a*, 162*b* are shown rotating at different speeds but in opposite directions by arrows 182*a*, 182*b*. In FIG. 6*c*, one rotatable portion 163*b* is shown as being held stationary (cross 183*b*) while the other rotatable portion 163*a* rotates (see arrow 183*a*). In all three cases, there is relative rotation between the rotatable portions 161*a*, 161*b*; 162*a*, 162*b*; 163*a*, 163*b* so that the effect of producing increased agitation of the contents of the drum 120 is achieved. It will be appreciated that the arrangements shown in FIG. 6 are also applicable to drums consisting of three or even more rotatable portions.

Figure 7A:
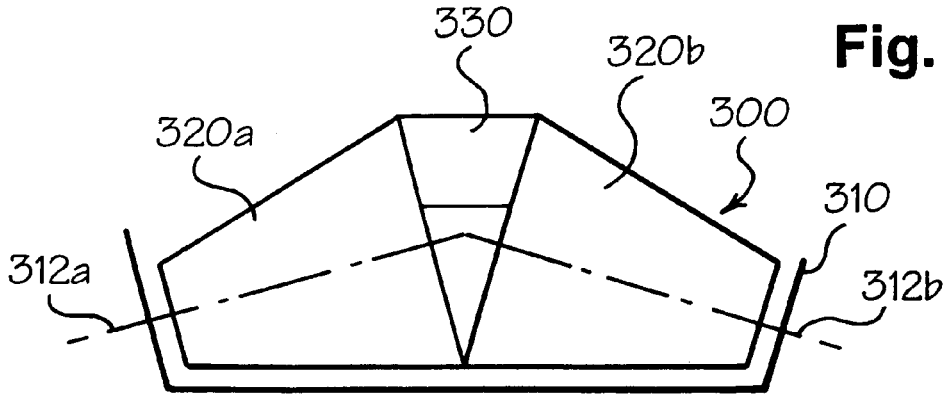
FIG. 7*a* is a front view of a sixth embodiment of the invention.
Figure 7B:
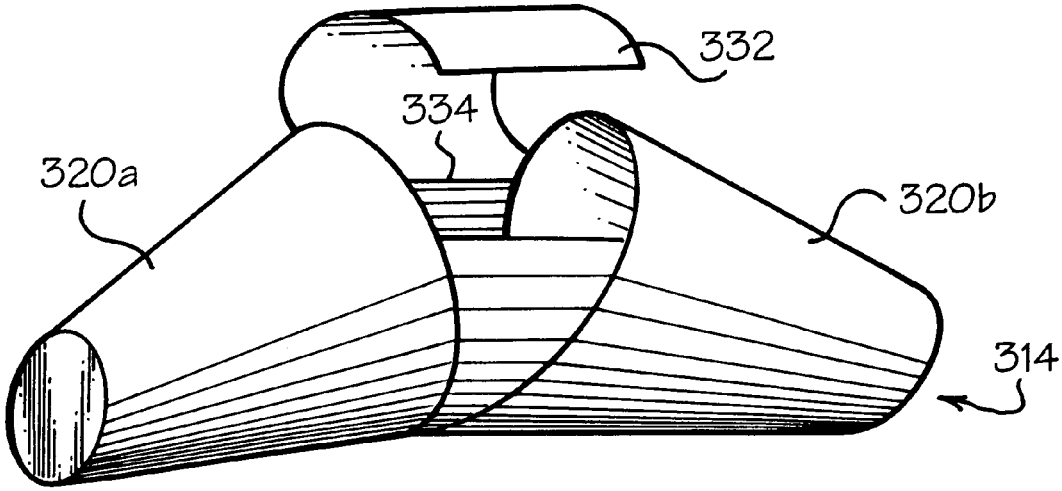
FIG. 7*b* is a perspective view of the embodiment shown in FIG. 7*a* in an open position.

A further alternative arrangement is illustrated in FIGS. 7*a* and 7*b*. In this arrangement, the washing machine 300 comprises a stationary tank 310 within which are supported, in any known manner, two rotatable portions 320*a*, 320*b* arranged on either side of a stationary portion 330. The stationary portion 330 incorporates an opening for inserting articles into the interior of the rotatable portions 320*a*, 320*b*. A door 332 can hingedly mounted about an axis 334 on the stationary portion 330 so as to maintain articles within the rotatable portions 320*a*, 320*b* during operation. The stationary portion 330 is essentially triangular in side view as shown in FIG. 7*a*. This allows the axes 312*a*, 312*b* about which the rotatable portions 320*a*, 320*b* are rotatable to be inclined to one another.

In use, the door 332 is opened in order to allow articles to be introduced through the opening of the stationary portion 330 and into the interior of the drum 314, and the door 332 is then closed. During operation, the rotatable portions 320*a*, 320*b* are rotated about the axes 312*a*, 312*b* while the stationary portion 330 remains stationary. This produces relative motion between each rotatable portion 320*a*, 320*b* and the stationary portion 330, even when the rotatable portions 320*a*, 320*b* are rotated at the same speed and in the same direction. However, it is expected that a higher degree of agitation will be achieved if the rotatable portions 320*a*, 320*b* are rotated about their respective axes 312*a*, 312*b* at different speeds and/or in different directions. As before, the tank or tub 310 contains a fluid, and at least one of the drum portions is perforated so that the fluid can flow from the drum 314 to the tank or tub 310 and vice versa.

Figure 8:
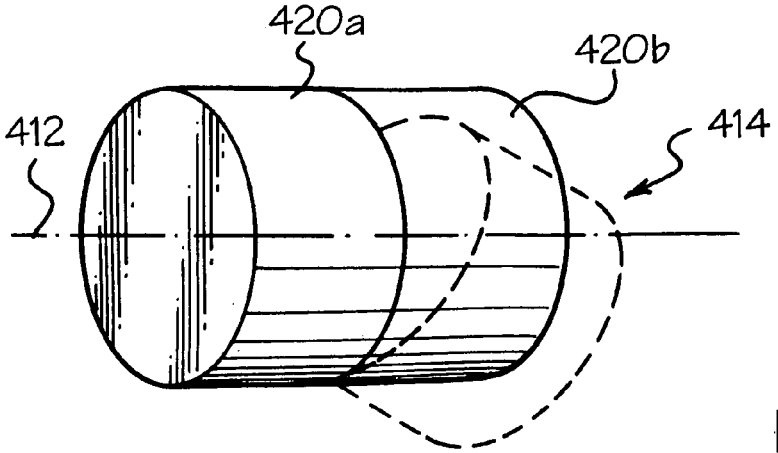
FIG. 8 is a perspective view of a seventh embodiment of the invention similar to the first embodiment but illustrating an alternative method of opening the drum.

It will be appreciated that drums which consist of two or more essentially cylindrical portions which are rotatable about a common axis can be opened to allow access without necessarily providing an openable door in a wall or peripheral portion of the drum. Since the drum is made up of separate portions, it is possible to allow for one of those portions to move away from the adjacent portion in order to provide access. One way of achieving this is illustrated schematically in FIG. 8. The drum 414 comprises two rotatable portions 420*a*, 420*b* which are rotatable about a common axis 412. No door is provided in either the cylindrical walls or circular end walls of either rotatable portion 420*a*, 420*b*. Instead, one of the rotatable portions 420*b* is mounted so that, when the drum 414 is to be opened, the entire rotatable portion 420*b* is pivoted away from the other rotatable portion 420*a*. The open position is illustrated in dotted lines in FIG. 8. In other respects, the construction of the embodiment illustrated in FIG. 8 is similar to that of the embodiments illustrated and described above.

A further embodiment of the invention is illustrated in FIG. 9. The apparatus 500 has a tub or tank 502 which surrounds and accommodates the drum 550. The tub or tank 502 is watertight so as to contain fluid therein. The tub or tank 502 has an inlet 504 and an outlet 506 for the inlet and drainage of fluid respectively. A door 508 is provided on the front wall of the tub or tank 502 so as to allow articles to be introduced through an opening into the interior of the drum 550. Preferably, the apparatus 500 is a washing machine, and all other elements not described specifically herein are conventional, not requiring further description.

The drum 550 is shown mounted in a cantilever fashion on the wall of the tub or tank 502 remote from the door 508. In accordance with the invention, the drum 550 is made up of two separate rotatable portions 560, 570. The first outer rotatable portion 560, is supported on a hollow cylindrical shaft 561. An angular contact bearing 562 is located between the rear wall of the tub 502 and the hollow cylindrical shaft 561. The outer rotatable portion 560 is dimensioned so as to substantially fill the interior of the tub 502. More specifically, the outer rotatable portion 560 has a generally circular rear wall 563 extending from the hollow cylindrical shaft 561 towards the cylindrical wall of the tub 502, a generally cylindrical wall 564 extending generally parallel to the cylindrical walls of the tub 502 from the rear wall 563 towards the front wall of the tub 502, and a generally annular front face 565 extending from the cylindrical wall 564, and having an opening for receiving the door 508. Sufficient clearance is allowed between the walls 563, 564, 565 of the outer rotatable portion 560 and the tub 502 to prevent the outer rotatable portion 560 from coming into contact with the tub 502 when the drum 550 is made to spin.

An inner cylindrical wall 566 is also provided on the interior of the cylindrical wall 564 of the outer rotatable portion 560. The inner cylindrical wall 566 extends from a point which is substantially midway between the rear wall 563 and the front face 565 to the front face 565. The space between the interior cylindrical wall 566 and the cylindrical wall 564 is hollow but, if desired, could be filled with a strengthening material. In this event, the strengthening material must be lightweight. The provision of parallel cylindrical walls 564, 566 in the portion of the outer rotatable portion 560 closest to the front face 565 provides strength to the whole of the outer rotatable portion 560 while reducing the internal diameter of the outer rotatable portion 560 in this region.

The inner rotatable portion 570 is supported on a central shaft 571, which in turn, is supported by deep groove bearings 572 located between the central shaft 571 and the hollow cylindrical shaft 561. The inner rotatable portion 570 essentially comprises a generally circular rear wall 573 extending from the central shaft 571 towards the cylindrical wall of the tub 502, and a cylindrical wall 574 extending from the periphery of the rear wall 573 towards the front wall of the tub 502. The diameter of the cylindrical wall 574 of the inner rotatable portion 570 is substantially the same as the diameter of the inner cylindrical wall 566 of the outer rotatable portion 560. The cylindrical wall 574 of the inner rotatable portion 570 is dimensioned so that the distal end thereof approaches the end of the cylindrical wall 566 closest thereto. It is advantageous to keep the gap between these two cylindrical walls 565, 566 as small as possible. An annular sealing ring 567 is located on the cylindrical wall 564 of the outer cylindrical portion 560 immediately adjacent to the end of the inner cylindrical wall 566 closest to the inner cylindrical portion 570 so as to provide support for the distal end of the cylindrical wall 565 thereof.

The central shaft 571 and the hollow cylindrical shaft 561 are each driven separately by drives 580, 582. The type of gearing used to couple the drives 580, 582 to the shafts 561, 571 is not critical to the operation of the invention, and any type of rotator member or coupling arrangement that would be known to one of ordinary skill in the art can be used. For example, a single or dual coupler unit as described in accordance with FIG. 3*a* and FIG. 3*b* can be used, with the rotator member being located on the shafts of the rotatable portions rather than on the periphery.

An exploded illustration of the inner and outer rotatable portions 570, 560 is shown in FIG. 10. As can be seen from FIGS. 9 and 10, the inner rotatable portion 570 is located inside the outer rotatable portion 560 so that the cylindrical wall 565 of the inner rotatable portion 570 is aligned with the inner cylindrical wall 566 of the outer rotatable portion. The central shaft 571 lies inside the hollow cylindrical shaft 561. Both of the inner and outer rotatable portions are preferably manufactured from stainless steel using manufacturing techniques which include clinching and welding, however the manner of manufacture is not essential to the present invention and it is envisaged that the rotatable portions could also be molded from a suitable plastics material.

Also located within each of the rotatable portions 560, 570 are paddles 590. In the illustrated embodiment, three equiangularly spaced paddles 590 are located on the cylindrical walls 565, 566 of each respective rotatable portion 570, 560. More or fewer paddles could be provided if desired. All of the paddles 590 are substantially identical and the shape thereof is illustrated in FIGS. 11*a* and 11*b*. As can be seen from FIG. 11*a*, the paddle 590 has a height which reduces significantly from one end 592 towards the other end 594. In each case, the end 592 will be placed directly adjacent the circular wall or end face of the rotatable portion 560, 570 to which the paddle 590 is attached. In the case of paddles 590 attached to the outer rotatable portion 560, the end 592 will be directly adjacent the annular end face 565, and in the case of paddles 590 attached to the inner rotatable portion 570, the end 592 of the paddle 590 will be directly adjacent the rear wall 573. The upper surface 596 of the paddle 590 has an arcuate portion adjacent the end 592 and this arcuate portion can extend over as little as one third or as much as three quarters of the length of the paddle 590. In the illustrated embodiment, the arcuate portion extends over more than half of the length of the paddle 590, more specifically over approximately two thirds of the length thereof. The remainder of the upper edge 596 of the paddle 590 extends parallel to the lower surface 598 thereof. Seen in plan view, as shown in FIG. 11*b*, the side edges 599 of the paddle 590 approach one another as they approach the distal end 594 of the paddle 590. Again, the side edges 599 are arcuate over part of their length, the remainder of the length thereof being parallel to one another.

The length of each paddle 590 is selected so that, when the paddles 590 are positioned on the cylindrical walls 566, 565 of the outer and inner rotatable portions 560, 570, the distal end 594 of each paddle 590 extends to a distance of between 10 and 30 millimeters from the gap between the cylindrical walls 566, 565. The shape of the upper surface 596 of each paddle 590 is selected so that the height of each paddle 590 adjacent the end 592 is sufficient to ensure that rotation of articles contained within the drum 550 is continuous when the drum is full or when heavy items are being agitated. However, the height of the paddles 590 is sufficiently small, adjacent the distal end 594, to provide a gentle agitation for delicate articles when this is required. In the preferred embodiment, when the apparatus 500 is a washing machine, suitable dimensions for a typical paddle are: a maximum height of substantially 50 millimeters, a minimum height of substantially 20 millimeters and a paddle length of substantially 190 millimeters.

The apparatus described above can be used in the following manner. Articles to be agitated are placed inside the drum 550 and liquid, preferably water, is introduced via the inlet 504 in a known manner. The temperature of the liquid can be adjusted as desired before being introduced into the apparatus 500 or it can be heated to a desired temperature by the apparatus 500 itself using any known heating mechanism. The rotatable portions 560, 570 are then rotated by the drives 580, 582 so that the speed and/or direction of rotation of one of the rotatable portions 560 is different from that of the other rotatable portion 570. The rotatable portions 560, 570 can be rotated at different speeds in the same direction, at the same speed in opposite directions, or at different speeds in opposite directions. Alternatively, one portion 560, 570 can be held stationary while the other portion 570, 560 rotates. In any event the speed of rotation of the rotating portions 570, 560 can be increased above the normal speed of rotation of washing machine drums during the washing cycle. In known machines this would not normally exceed 50 rpm. Even at speeds of rotation far in excess of 50 rpm, the contents of the drum 550 according to the invention do not stick to the wall of the drum and therefore the agitation applied to the said contents can be greatly increased.

When apparatus 500 is used as a washing machine, a rinsing cycle can be employed by draining wash water from the drum 550 via the outlet 506 in a known manner, and introducing clean water via the inlet 504. The rotatable portions 560, 570 continue to be rotated in the same manner as that during typical agitation in order to maintain a high level of agitation while rinsing the articles. After rinsing, the rotatable portions 560, 570 are rotated at the same speed and in the same direction in order to spin excess water from the articles in the usual way. The rotatable portions 560, 570 may be fixed together at this point by locking the drum portions together in order to ensure that there is little or no relative movement between the rotatable portions 560, 570 during spinning. If this fixing occurs, all but one of the drives 580, 582 may be shut off so that all or both portions 560, 570 are driven by a single drive. Alternatively, the drives 580, 582 may be arranged so that all or both rotatable portions 560, 570 are driven in the same direction and at the same speed during spinning with any minor differences in speed being kept under control merely by the presence of the contents of the drum 550. With the increased agitation of the contents of the drum 550, it is envisaged that the duration of a normal agitation cycle, currently about 90 minutes in a washing machine, can be reduced by about half, possibly more, without there being any reduction in the standard of quality.

The drum of the present invention can be advantageously applied to any apparatus in which the contents of a container requires to be agitated to a high degree and where a shortening of the duration of the agitation would be an advantage. It is preferable that the drum be used in a washing machine. However, other applications include polishing (e.g. of semi-precious stones), grinding, granulating, peeling (e.g. of foodstuffs such as potatoes) and coating. Furthermore, variations of the apparatus described above are intended to be included within the scope of the invention. For example, the shape of the drum need not be cylindrical and spherical and ovoid drums are envisaged. The rotatable portions may also be arranged so that they are not generally similar to one another. For example, in a cylindrical drum, one portion may make up the cylindrical wall of the drum while another portion may make up a circular end wall of the drum.

Having now fully described this invention, it will be appreciated by those persons of ordinary skill in the art that the invention can be performed within a wide range of parameters without departing from the spirit and scope of the invention. The embodiments described herein are meant to be illustrative of the overall invention and should not be taken as limiting the invention from what is claimed.

What is claimed is:

1. A washing machine comprising a drum for containing and agitating an article of clothing, wherein the drum comprises at least two rotatable portions in rotatable connection relative to one another about an axis, and wherein the drum has at least one port for intake or exhaust of a liquid to or from an area internal to the drum.

2. The washing machine of claim 1, wherein the at least one port is on a peripheral portion of the drum.

3. The washing machine of claim 1, wherein the dram is seated in a tank.

4. The washing machine of claim 1, wherein the rotatable portions are rotatable about a common axis.

5. The washing machine of claim 4, wherein the axis is horizontal.

6. The washing machine of claim 4, wherein the rotatable portions are rotatable in opposite directions.

7. The washing machine of claim 1, wherein the drum comprises two rotatable portions, each rotatable portion being substantially cylindrical in shape.

8. The washing machine of claim 1, further comprising a controller capable of controlling adjacent rotatable portions to rotate at the same speed in opposite directions.

9. The washing machine of claim 1, further comprising a motor connected to a coupler, and a controller connected to the motor to control speed and directional rotation of the rotatable portions.

10. The washing machine of claim 1, wherein each rotatable portion is connected to a common drive.

11. The washing machine of claim 1, wherein each rotatable portion is connected to a separate drive.

12. The washing machine of claim 1, wherein a first of the rotatable portions is located inside a second of the rotatable portions.

13. The washing machine of claim 12, wherein the second rotatable portion has a recess portion in which the first rotatable portion is accommodated.

14. The washing machine of claim 13, wherein the second rotatable portion has an operative portion separate from the recess portion.

15. The washing machine of claim 14, wherein the operative portion of the second rotatable portion has a diameter that is substantially the same as the diameter of the first rotatable portion.

16. The washing machine of claim 12, wherein the first and second rotatable portions are mounted on concentric shafts.

17. The washing machine of claim 1, wherein the rotatable portions are rotatable in opposite directions.

18. A washing machine comprising a drum for containing and agitating an article of clothing, wherein the drum comprises at least two rotatable portions in rotatable connection relative to one another about an axis, and wherein at least one of the rotatable portions has at least one port for intake or exhaust of a liquid to or from an area internal to the drum.

19. The washing machine of claim 18, wherein the at least one port is on a peripheral portion of at least one of the rotatable portions.

20. A washing machine comprising a drum for containing and agitating a washable article, wherein the drum comprises at least two rotatable portions in rotatable connection relative to one another, wherein one of the rotatable portions has an end wall attached thereto and another of the rotatable portions has an end wall with an opening therein for inserting the article into the drum, and wherein at least one port is located on the drum for intake or exhaust of a liquid to or from an area internal to the drum.

21. The washing machine of claim 20, wherein the at least one port is on a peripheral portion of the drum.

22. The washing machine of claim 21, wherein the at least one port is on a peripheral portion of at least one of the rotatable portions.

23. The washing machine of claim 20, wherein the drum is seated in a tank.

24. The washing machine of claim 20, wherein a one of the rotatable portions is located inside another rotatable portion.

25. The washing machine of claim 24, wherein the rotatable portions are mounted on concentric shafts.

26. The washing machine of claim 25, wherein the rotatable portions are rotatable in opposite directions.

27. The washing machine of claim 20, wherein the rotatable portions are rotatable in opposite directions.

28. A washing machine comprising a drum for containing and agitating an article, wherein the drum comprises two rotatable portions in rotatable connection relative to one another, wherein an opening for inserting the article into the drum is provided at a peripheral portion of one or more of the rotatable portions, and wherein at least one port is located on the drum for intake or exhaust of a liquid to or from an area internal to the drum.

29. The washing machine of claim 28, wherein the at least one port is on a peripheral portion of the drum.

30. The washing machine of claim 29, wherein the at least one port is on a peripheral portion of at least one of the rotatable portions.

31. The washing machine of claim 28, wherein the drum is seated in a tank.

32. The washing machine of claim 28, wherein one of the rotatable portions is located inside another rotatable portion.

33. The washing machine of claim 32, wherein the rotatable portions are mounted on concentric shafts.

34. The washing machine of claim 33, wherein the rotatable portions are rotatable in opposite directions.

35. The washing machine of claim 28, wherein the rotatable portions are rotatable in opposite directions.

36. A drum type washing machine, comprising a tub fitted in a cabinet; a drum fitted in the tub comprising at least two rotatable portions in rotatable connection relative to one another about an axis to be rotatable in opposite directions; and at least one port is located on one of the drums for intake or exhaust of a liquid to or from an area internal to the drum.

37. The drum type washing machine of claim 36, wherein the drum comprises an outer drum rotatably fitted in the tub and an inner drum rotatably fitted in the outer drum having a diameter and a length smaller than the outer drum, respectively.

* * * * *

UNITED STATES PATENT AND TRADEMARK OFFICE

CERTIFICATE OF CORRECTION

PATENT NO. : 7,197,901 B2
APPLICATION NO. : 10/833302
DATED : April 3, 2007
INVENTOR(S) : Andre F. Monteiro et al.

It is certified that error appears in the above-identified patent and that said Letters Patent is hereby corrected as shown below:

Claim 3, column 11, line 7, delete "dram" and replace with --drum--

Signed and Sealed this

Nineteenth Day of June, 2007

JON W. DUDAS
*Director of the United States Patent and Trademark Office*